US007560209B2

(12) United States Patent
Tokutake et al.

(10) Patent No.: US 7,560,209 B2
(45) Date of Patent: Jul. 14, 2009

(54) ELECTROPHOTOGRAPHIC IMAGE FORMING APPARATUS AND IMAGE FORMING UNIT

(75) Inventors: Shigeaki Tokutake, Hachioji (JP); Takao Fukaya, Hachioji (JP); Tsuyoshi Shimoda, Musashino (JP); Shinichi Hamaguchi, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 397 days.

(21) Appl. No.: 11/438,735

(22) Filed: May 22, 2006

(65) Prior Publication Data

US 2007/0048013 A1 Mar. 1, 2007

(30) Foreign Application Priority Data

Aug. 23, 2005 (JP) ..... 2005-240905

(51) Int. Cl.
*G03G 15/00* (2006.01)

(52) U.S. Cl. ..... 430/66; 430/126.1; 399/121; 399/302

(58) Field of Classification Search ..... 219/219, 219/121.67, 121.72, 121.85, 121.6; 493/212–214; 430/66, 126.1; 399/121, 302
See application file for complete search history.

(56) References Cited

U.S. PATENT DOCUMENTS

| | | | | |
|---|---|---|---|---|
| 6,558,862 | B2 * | 5/2003 | Kojima et al. | 430/58.05 |
| 6,775,511 | B2 * | 8/2004 | Kosuge | 399/346 |
| 2001/0044060 | A1 * | 11/2001 | Shida et al. | 430/58.2 |
| 2005/0058473 | A1 * | 3/2005 | Mizuno et al. | 399/302 |
| 2005/0207788 | A1 * | 9/2005 | Bandou et al. | 399/159 |
| 2005/0207800 | A1 * | 9/2005 | Yamaguchi et al. | 399/302 |
| 2006/0014092 | A1 * | 1/2006 | Nukada et al. | 430/60 |
| 2006/0029870 | A1 * | 2/2006 | Nukada et al. | 430/56 |

* cited by examiner

*Primary Examiner*—Hoa V Le
(74) *Attorney, Agent, or Firm*—Lucas & Mercanti, LLP

(57) ABSTRACT

An electrophotographic image forming apparatus, comprises an electrophotographic photoreceptor; an image forming section for forming a toner image on a surface of the electrophotographic photoreceptor; an intermediate transfer member; a first transferring section for transferring the toner image formed on the surface of the electrophotographic photoreceptor to a surface of the intermediate transfer member; and a second transferring section for transferring the toner image transferred on the surface the intermediate transfer member to a recording medium; wherein the electrophotographic photoreceptor comprises a surface layer forming the surface thereof and containing particles having a number average primary particle diameter of 1 to 300 nm and the surface of the electrophotographic photoreceptor has a hardness of 200 to 350 N/mm$^2$ in universal hardness which is lower than the hardness in universal hardness of the surface of the intermediate transfer member.

18 Claims, 3 Drawing Sheets

ELECTROPHOTOGRAPHIC IMAGE FORMING APPARATUS AND IMAGE FORMING UNIT

BACKGROUND OF THE INVENTION

The invention relates to an electrophotographic image forming apparatus and an image forming unit.

Recently, an image forming method by a digital system becomes main stream in the field of electrophotographic image formation accompanied with progress in the digital technology. In the image forming method by the digital system, it is demanded sometimes to realize a small dot image of one pixel such as 1,200 dpi, number of the dot per 1 inch or 2.54 cm. Therefore, a high quality image forming technology capable of precisely reproducing such the small dot is required. Demands for miniaturization, rising in the image resolution, and full color printing in copy machines particularly rise recently. In the case of printer, demand for stably printing images having the image quality equal to images formed by ordinal printing process rises also. Accordingly, higher image forming technology is required for stably forming a high quality toner image.

Investigations on the developing means and the electrophotographic photoreceptor have been carried out for obtaining the high quality image.

Developing means in the electrophotographic technology can be roughly classified into a dry developing means and a wet developing means.

The dry developing means is a method using a toner in a powder state and is further classified into a dry double-component type using a developer containing a toner, a carrier and another additive and a dry single-component type using a developer containing a toner and another additive other than carrier.

On the other hand, the wet developing means is a method using a liquid developer composed of a carrier liquid and a toner dispersed in the carrier liquid. The wet developing method has merits comparing with the dry developing method that the diameter of the toner is smaller and the transparency of the toner is higher than those of the developer for the dry developing method. Therefore, the wet developing method has peculiarities that a high quality toner image can be obtained either by analogical or digital system and also in monochromatic or color image formation, and further an image forming apparatus capable of saving energy can be obtained.

An image forming apparatus is proposed, cf. Patent Document 1 for example, in which a toner image formed on an electrophotographic photoreceptor is transferred onto a recording medium by applying bias voltage for transferring applied through a transfer roller contacting to the image carrying member by a bias voltage applying means, and an insulating layer having a volume resistivity of not less than $1\times10^7$ Ωcm and a harness lower than that of the surface of the image carrying member is provided on the surface of the transfer roller, and the bias voltage applying means has a function of applying removing bias voltage for transferring the toner adhering on the transfer roller onto the image carrier (for example, refer Patent Document "Tokkai 2004-94037".

Furthermore, investigations about the hardness of the electrophotographic photoreceptor and that of the intermediate transfer member have been carried out for preventing locally lacking of the image transfer. Regarding such the point, it has been proposed to make the dynamic hardness of the surface of the electrophotographic photoreceptor to higher than that of the intermediate transfer member; cf. Patent Document "Tokkai 2003-149950" for example.

An electrophotographic photoreceptor containing particles in the surface layer thereof is proposed for obtaining a lot of high quality toner image; cf. Patent Document "Tokkai 2005-43623" for example. However, further improvement is demanded because white lacking in a solid image, lacking inside a character image, occurrence of black spots and fogging, lowering-in the image density and the image sharpness in the course of printing many prints are caused so that the desired high quality image cannot be stably obtained when an electrophotographic photoreceptor, hereinafter referred to as simply photoreceptor, according to such the proposals is applied for an photoelectric image forming apparatus, hereinafter sometimes referred to as simply image forming apparatus.

SUMMARY OF THE INVENTION

The invention provides an image forming apparatus with the following structures by which a high quality toner image without any image defect can be continuously obtained.

An electrophotographic image forming apparatus, comprises:

an electrophotographic photoreceptor;

an image forming section for forming a toner image on a surface of the electrophotographic photoreceptor;

an intermediate transfer member;

a first transferring section for transferring the toner image formed on the surface of the electrophotographic photoreceptor to a surface of the intermediate transfer member; and a second transferring section for transferring the toner image transferred on the surface the intermediate transfer member to a recording medium;

wherein the electrophotographic photoreceptor comprises a surface layer forming the surface thereof and containing particles having a number average primary particle diameter of 1 to 300 nm and the surface of the electrophotographic photoreceptor has a hardness of 200 to 350 N/mm$^2$ in universal hardness which is lower than the hardness in universal hardness of the surface of the intermediate transfer member.

DETAILED DESCRIPTION OF THE PREFERRED EMBODIMENT

Figure 1:
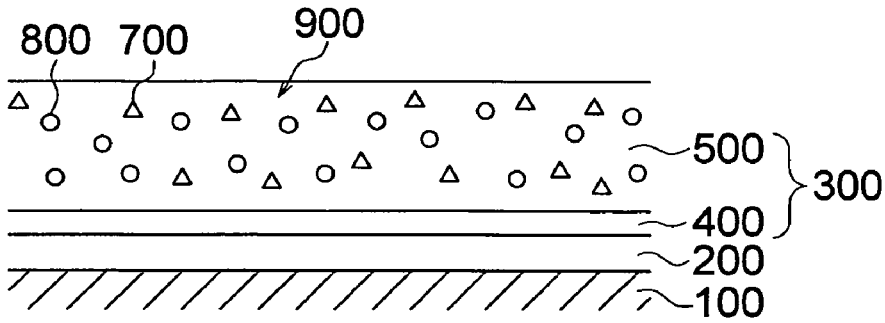
FIG. 1 shows a schematic drawing of an example of layer structure of photoreceptor according to the invention.
Figure 1:
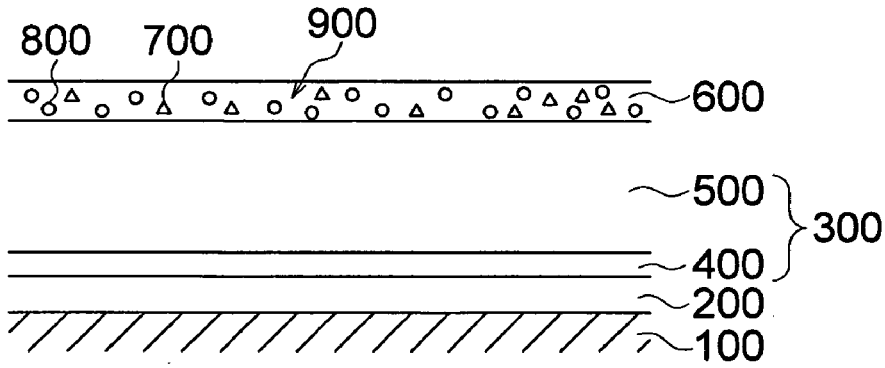

The inventors investigate about an image forming apparatus by which the white lacking in a solid image and inside a character image, and occurrence of black spots and fogging, lowering in the image density and the image sharpness in the course of printing of many prints are not caused so that high quality toner images can be continuously obtained.

As a result of the investigation, it has been found that the above problems can be solved by adding a particle having an average diameter of primary particles of from 1 to 300 nm into the surface layer of the photoreceptor and controlling the hardness of the surface of the photoreceptor to a universal hardness of from 200 to 350 N/mm$^2$ and making the hardness of the surface of the photoreceptor to lower (softer) than that of the surface of the intermediate transfer member used as the transfer means.

When an inorganic particle and an organic particle are contained with together in the surface layer of the photoreceptor, it is supposed that the inorganic particle prevents the occurrence of the white lacking in the image and improves the transfer efficiency and the organic particle accelerates the releasing of the toner image so as to prevent the lacking inside the character image and inhibits the lowering in the image resolution caused by deforming of the toner image on the occasion of the image transfer though the reason of such the effects is not cleared yet.

It is further supposed that the deformation of the toner image on the occasion of transferring the toner image onto the intermediate transfer member by contacting the photoreceptor to the intermediate transfer member can be inhibited so as to transfer the toner image while maintaining the high image resolution by making the hardness (universal hardness) of the surface of the photoreceptor to be lower than the hardness (universal hardness) of the surface of the intermediate transferring layer.

It is supposed that the abrasion of the surface of the photoreceptor by the cleaning member used as the cleaning means is reduced by adding the inorganic particle and the organic particle into the surface layer of the photoreceptor so that the occurrence of the black spots and fog, lowering in the image density and the sharpness caused by the abrasion of the photoreceptor surface are prevented and the high quality toner image can be stably obtained.

Moreover, it is supposed that the high quality toner image can be continuously obtained by using an elastic blade for the cleaning means, coating a lubricant onto the photoreceptor surface and adding a slipping agent or an abrasive into the toner to be used in the developing means.

The invention is described in detail below.

First, the particle diameter of the particle is described.

[Diameter of the Particle]

The particle to be used in the invention has a number average diameter of primary particles of from 1 to 300 nm, preferably from 10 to 250 nm, and more preferably from 30 to 200 nm.

The number average diameter of primary particles is a value determined by a method in which the image of the particles is enlarged by 10,000 times by a transmission electron micrometer and 100 primary particles randomly selected from the enlarged image are subjected to image analysis.

As the transmission electronmicroscope, H-9000NAR, manufactured by Hitachi Seisakusho Co., Ltd, and JEM-200FX, manufactured by Nihon Denshi Co., Ltd., can be exemplified.

The observation by the transmission electronmicroscope is carried out by a method commonly applied for determined the diameter of a particle. The determination is carried out, for example, by the following procedure. First, a sample for observation is prepared. The particles are sufficiently dispersed in epoxy resin hardenable at ordinary temperature and embedded and solidified to prepare a block. The resultant block is sliced by a microtome having a diamond cutting edge into a slice having a thickness of from 80 to 200 nm to prepare a sample for determination. Then the sample is enlarged by the transmission electronmicroscope (TEM) by 10,000 times and photographed. Thus obtained photographic image information of 100 particles is processed by an image processing apparatus LUZEX F, manufactured by Nicole Co., Ltd., to obtain the number average diameter of the primary particles.

The particles having the number average primary particle diameter within the above-described range can be uniformly dispersed in a binder. Therefore, formation of coagulated particle and large irregularity at the surface can be prevented. As a result of that, a satisfactory toner image can be obtained without occurrence of the black spots and the transfer memory caused trap and the black spots caused by the large irregularity of the surface. Moreover, such the particle is difficultly precipitated in the coating liquid and excellent in the stability of the liquid.

Next, the hardness (universal hardness) of the surface is described bellow.

[Hardness (Universal Hardness) of the Surface]

The photoreceptor to be used in-the invention has a hardness (universal hardness) of the surface of from 200 to 350 $N/mm^2$ and the hardness is lower than that of the surface of the intermediate transfer member.

The hardness (universal hardness) of the surface can be measured by the use of a surface physical property measuring apparatus according to the following conditions.

Measuring conditions

Measuring apparatus: Hardness tester pushing testing apparatus H100V, manufactured by Fischer Instrument Co., Ltd.

Measuring probe (pressing head): Vickers pressing head

Measuring condition: 20° C., 60% RH

Measurement sample: Intermediate transfer member was cut into a size of 5 cm×5 cm to produce a measurement sample Maximum testing loading weight: 2 mN Loading weight condition: With speed to reach the maximum testing loading weight in 10 seconds, a weight was loaded proportionally with time Loading weight creep time: 5 seconds In the measurement, the measurement was carried out at optionally selected 10 points on each sample and the average of the measured values was made the hardness defined by the universal hardness The photoreceptor is described below.

[Photoreceptor]

The photoreceptor to be used in the invention is the followings.

1. The surface layer of the photoreceptor contains the particles having a number average primary particle diameter of from 1 to 300 nm.

2. The surface of the photoreceptor has a hardness (universal hardness) of from 200 to 350 $N/mm^2$, preferably 250 to 350 $N/mm^2$.

The surface hardness (universal hardness) of the surface of the photoreceptor is lower (softer) than that of the surface (portion) of the intermediate transfer member, and is preferably not less than more than 20 $N/mm^2$, and more preferably in concrete from 25 to 80 $N/mm^2$, and is lower than the hardness of the surface of the intermediate transfer member.

(Layer Constitution of Photoreceptor)

The photoreceptor to be used in the invention is not limited to the layer structure thereof as long as it contains the particle having a number average primary particle diameter of from 1 to 300 nm in the surface layer thereof and the surface has a hardness (universal hardness) of from 200 to 350 $N/mm^2$. In concrete, the photoreceptor may have the following constitutions.

1) A constitution in which a charge generation layer and a charge transfer layer are successively laminated as a photosensitive layer on an electroconductive substrate.

2) A constitution in which a charge generation layer, a charge transfer layer and a protective layer are successively laminated as a photosensitive layer on an electroconductive substrate.

3) A constitution in which a layer containing a charge transfer material and a charge generation material is singly formed as a photosensitive layer on an electroconductive substrate.

4) A constitution in which a layer containing a charge transfer material and a charge generation material and a protective layer are formed as a photosensitive layer on an electroconductive substrate.

5) A constitution in which a charge transfer layer and a charge generation layer are successively laminated as a photosensitive layer on an electroconductive substrate.

6) A constitution in which a charge transfer layer, a charge generation layer and a protective layer are successively laminated as a photosensitive layer on an electroconductive substrate.

Among the above-mentioned, one constituted by successively laminating an intermediate layer, a charge generation layer, a charge transfer layer and a protective layer on an electroconductive substrate is preferable even though any of the above-mentioned constitutions may be applied for the photoreceptor to be used in the invention.

In the invention, an intermediate layer can be provided between the electroconductive substrate and the photosensitive layer for improving the electric properties and the adhesion.

The surface layer is a layer contacting with air atmosphere; the charge transfer layer is the surface layer when the intermediate layer, charge generation layer and charge transfer layer are successively provided on the electroconductive substrate and the protective layer is the surface layer when the protective layer is provided on the charge transfer layer.

FIG. 1 is a schematic drawing showing an example of the layer constitution of the photoreceptor.

FIG. 1*a* shows a photoreceptor in which the surface layer is the charge transfer layer, and FIG. 1*b* shows a photoreceptor in which the protective layer is the surface layer.

In FIG. 1, 100 is the electroconductive substrate, 200 is the intermediate layer, 300 is the photosensitive layer, 400 is the charge generation layer, 500 is the charge transfer layer, 600 is the protective layer, 700 is the inorganic particle, 800 is the organic particle and 900 is the surface layer.

(Particle)

The particle having the foregoing number average primary particle diameter can be uniformly dispersed in the coating liquid so as to prevent the formation of coagulated particle and the large irregularity at the surface. Consequently, the satisfactory toner image can be obtained without occurrence of the black spots and the transfer memory caused by the coagulated particle functioning as a charge trap and the black spots caused by the large irregularity on the surface. The particle is difficultly precipitated in the coating liquid and the dispersion stability of the liquid is also superior.

In the invention, it is preferable that the particle contains an inorganic particle and an organic particle.

The ratio of the inorganic particle to the organic particle is preferably from 20 to 80%, and more preferably from 30 to 70%, by weight.

As the inorganic particle, a particle of silica, alumina, titanium dioxide and strontium titanate can be exemplified. Among them, the silica particle and the alumina particle are preferable.

The number average primary particle diameter is preferably from 10 to 150 nm.

As the inorganic particle according to the invention, one treated on the surface thereof is preferable for raising the dispersing ability and stabilizing the electrophotographic characteristics. For example, an inorganic particle covered by an organic silicone compound is obtained by the following procedure; the inorganic particles are added into a liquid composed of a reactive organic silicone compound dissolved or suspended in an organic solvent or water and stirred for a time of from several minutes to about 1 hour, and then the resultant liquid was heated in some cases, filtered and dried. The reactive silicone compound may be added into a suspension composed of the inorganic particles dispersed in an organic solvent or water.

The amount of the reactive silicone compound to be used for the surface treatment is preferably from 0.1 to 50, and more preferably from 1 to 10, parts by weight to 100 parts by weight of the foregoing titanium oxide treated by the metal oxide in the amount at the time of charging to the above surface treatment. When the amount of the surface treating agent is smaller than the above-mentioned amount, the effect of the surface treatment cannot be sufficiently obtained so that the dispersing ability of the titanium oxide particle in the intermediate layer is lowered. The amount of the reactive organic silicone compound exceeding the above-mentioned range degrades the electric properties so as to cause increasing in the remaining potential and lowering in the charging potential.

Though compounds represented by the following Formula 1 can be cited as examples of the reactive organic silicone compound, the compound is not limited to the above as long as it can be condensed with a reactive group on the surface of the inorganic particle such as a hydroxyl group.

$$(R_1)_n\text{—Si—}(X_1)_{4-n} \qquad \text{Formula 1}$$

In the above formula, Si is a silicone atom, $R_1$ is an organic group directly bonded to the silicone atom through the carbon atom thereof, $X_1$ is a hydrolyzable group and n is an integer of from 0 to 3.

In the organic silicone compound represented by Formula 1, examples of the organic group represented by $R_1$ which is directly bonded to the silicone atom through the carbon atom thereof include an alkyl group such as a methyl group, an ethyl group, a propyl group, a butyl group, a pentyl group, a hexyl group, an octyl group and a dodecyl group, an aryl group such as a phenyl group, a tolyl group, a naphthyl group and a biphenyl group, an epoxy-containing group such as a γ-glycidoxypropyl group and a β-(3,4-epoxycyclohexyl) ethyl group, a (meth)acryloyl-containing group such as a γ-acryloxypropyl group and a γ-methacryloxypropyl group, a hydroxyl group-containing group such as a γ-hydroxypropyl group and 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group, and an N-β(aminoethyl)-γ-aminopropyl group, a holgen-containing group such as a γ-chloropropyl group, a 1,1,1-trifluoropropyl group, a nonafluorohexyl group and a perfluoroctylethyl group, an alkyl group substituted by a nitro group or a cyano group. As the hydrolyzable group represented by $X_1$, an alkoxyl group such as a methoxy group and an ethoxy group, a halogen and an acyloxy group can be cited.

The organic silicone compound represented by Formula 1 may be used singly or in combination of two or more kinds thereof.

In the concrete organic silicone compound represented by Formula 1, plural groups each represented by $R_1$ may be the same or different when n is 2 or more, and plural groups each represented by $X_1$ may be the same or different when n is 2 or less. When two or more kinds of the compound represented by Formula 1 are used, $R_1$ and $X_1$ each may be the same or different between the compounds.

Moreover, a hydrogen polysiloxane compound is usable as a preferable reactive organic silicone compound to be used for the surface treatment. The hydrogen polysiloxane compound having a molecular weight of from 1,000 to 20,000 is easily available and shows suitable black spot inhibiting effect. The use of methylhydrogen polysiloxane shows satisfactory effect.

Another inorganic particle according to the invention is one treated on the surface by an organic silicone compound having a fluorine atom. The surface treatment by the organic silicone compound having a fluorine atom is preferably carried out by the foregoing wet process.

The organic silicone compound having a fluorine atom is dissolved or suspended in an organic solvent or water and the untreated inorganic particles are added into the resultant liquid and stirred for a time of from several minutes to about 1 hour, and then the resultant liquid was heated in some cases, filtered and dried to cover the surface of the inorganic particle by the organic silicone compound having a fluorine atom. The reactive silicone compound having a fluorine atom may be added into a suspension composed of the inorganic particles dispersed in an organic solvent or water.

Examples of the organic silicone compound having a fluorine atom include 3,3,4,4,5,5,6,6,6-nonafluoro-hexyltrichlorosilane, 3,3,3-trifluoropropyltrimethoxysilane, methyl-3,3,3-trifluoropropyldichlorosilane, dimethoxy-methyl-3,3,3-trifluoropropylsilane and 3,3,4,4,5,5,6,6,6-nonafluorohexylmethyldichlorosilane.

Concrete examples of another reactive organic titanium compound include a metal alkoxide compound such as titanium tetrapropoxide and titanium tetrabutoxyide, and a metal chelate compound such as titanium diisopropoxide-bis(acetylacetate), titanium diisopropoxide-bis(ethylacetoacetate), titanium diisopropoxide-bis(lactate), titanium dibutoxide-bis(octyleneglycolate) and titanium diisopropoxide bis(triethanolaminate). Examples of a reactive organic zirconium compound, a metal alkoxide compound such as zirconium tetrabutoxide and zirconium butoxide-tri(acetylacetate) and a metal chelate compound.

The organic particle is selected from a fluorine atom-containing particle, a polyolefin particle, a polyester particle and a silicone atom-containing particle. Among them, a particle of fluorine atom-containing polyester is preferable.

The fluorine atom-containing particle is preferably one or more selected from, for example, a particle of a tetrafluoroethylene resin, a trifluorocloroethylene resin, a hexafluoroethylenepropylene resin, a vinyl fluoride resin, a vinylidene fluoride resin, difluorodichloroethylene resin and a copolymer thereof. The particle of trifluorochloroethylene resin, tetrafluoroethylene resin and that of vinylidene fluoride are particularly preferable.

The number average primary particle diameter of the organic particle is preferably from 20 to 250 nm.

The ratio of the inorganic particle to the organic particle is preferably from 20 to 80%, and more preferably from 30 to 70%, by mass.

[Hardness (Universal Hardness) of the Surface of Photoreceptor]

The hardness (universal hardness) of the surface of the photoreceptor can be controlled by the kind of resin forming the surface, the kind, diameter, content of the particle to be added and the layer forming method.

In concrete, the hardness of the surface of the photoreceptor can be increased by adding a large amount of the inorganic particle having high hardness or hardening the resin forming the surface.

[Production of the Photoreceptor]

The photoreceptor can be produced by forming the layer by an immersion coating method, circular coating amount controlling coating method or a combination of them, but the coating method is not limited to them. The circular coating amount controlling type coating method is described in detail in Tokkai Sho 58-189061.

Materials and layers constituting the photoreceptor of the invention are each described below.

(Electroconductive Substrate)

The electroconductive substrate to be used in the invention preferably has cylindrical shape and a relative resistivity of not more than $10^3$ Ωcm. Concrete example is an aluminum cylinder washed on the surface after shaving process.

[Intermediate Layer]

The intermediate layer is formed by coating an intermediate layer coating liquid containing a binder, the inorganic particles and a dispersing solvent on the electroconductive substrate.

As the binder of the intermediate layer, a polyamide resin, a vinyl chloride resin, a vinyl acetate resin and a copolymer containing two or more repeating units of the above polymers are usable. Among these resins, the polyamide resin is preferable because the increasing in the remaining potential accompanied with repeating use can be inhibited.

The solvent for preparing the intermediate layer coating liquid is preferably one capable of satisfactorily dispersing the inorganic particles and dissolving the polyamide resin. In concrete, alcohols having 2 to 4 carbon atoms such as ethanol, n-propyl alcohol, isopropyl alcohol, n-butanol, t-butanol and sec-butanol are preferable, which are superior in dissolving ability to the polyamide resin and in the coating suitability. The content of such the solvent in the entire solvent is from 30 to 100%, preferably from 40 to 100%, and further preferably from 50 to 100%, by weight. An assistant solvent such as methanol, benzyl alcohol, toluene, methylene chloride, cyclohexane and tetrahydrofuran gives preferable effect by using together with the foregoing solvent.

The thickness of the intermediate layer is preferably from 0.2 to 40 μm, and more preferably from 0.3 to 20 μm.

The photosensitive layer preferably has a constitution in which the function of photoreceptor is separated into a charge generation layer (CGL) and a charge transfer layer (CTL) though the constitution may be a single layer structure having both of the charge generation function and the charge transfer function. Increasing in the remaining potential accompanied with repeating use can be inhibited and other electrophotographic properties can be easily controlled by the function separating constitution. In a photoreceptor to be negatively charged, the charge generation layer is provided on the intermediate layer and the charge transfer layer is arranged on the charge generation layer. In a photoreceptor to be positively charged, the order of the charge generation layer and the charge transfer layer is revered. Preferable layer constitution of the photoreceptor is the negatively charging photoreceptor having the function separating structure.

<Charge Generation Layer>

The charge generation layer contains a charge generation material (CGM). A binder and another additive may be added additionally to the charge generation material according to necessity.

Known charge generation materials (CGM) such as a phthalocyanine pigment, an azo pigment, a perylene pigment and an azulenium pigment can be used.

Though known resins can be used as the binder when the binder is used in the charge generation layer as a dispersing medium for the CGM, a formal resin, a butyral resin, a silicon resin a silicon-modified butyral resin and a phenoxy rein are particularly preferable. The ratio of the charge generation material to the binder is preferably from 20 to 600 parts by weight to 100 parts by weight of the binder. The remaining potential increasing accompanied with repeating use can be made minimum by the use of such the resins. The thickness of the charge generation layer is preferably from 0.01 to 2 μm.

<Charge Transfer Layer>

When the charge transfer layer is the surface layer, the layer comprises the particle according to the invention, the charge transfer material (CTM) and a binder. Another additive such as an antioxidant may be added. The thickness of the charge transfer layer is preferably from 0.2 to 40 μm, and more preferably from 0.3 to 20 μm.

When the charge transfer layer is the surface layer, the amount of the particle according to the invention in the charge transfer layer is preferably from 5 to 50%, and more preferably from 10 to 30%, by weight.

Examples of the resin usable in the charge transfer layer (CTL) include a polystyrene resin, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicon resin, a melamine resin and a copolymer containing two or more repeating units of the above resins. Other than the above, a polymer semiconductor such as Poly-N-vinylcarbazole is usable.

Among them, the polycarbonate resin is most preferable for the binder of the CTL. The polycarbonate resin is most preferable since the rein is superior in the dispersing ability for the CTM and ability for improving the electrophotographic properties. The ratio of the charge transfer material to the binder is from 10 to 200 parts by weight to 100 parts by weight of the binder. The thickness of the charge transfer layer is preferably from 10 to 40 μm.

Known antioxidants such as IRGANOX 1010, manufactured by Nihon Ciba-Geigy Co., Ltd., can be used.

<Protective Layer>

The protective layer is formed by a mixture of particle according to the invention, the charge transfer material, a resin having anti-wearing ability and a hardenable resin. For example, a polycarbonate resin, an acryl resin, a phenol resin, an epoxy resin, a urethane resin and a siloxane resin are usable for the protective layer.

The amount of the particle in the protective layer is preferably from 5 to 50%, and more preferably from 10 to 30%, by weight.

The intermediate transfer member is described bellow.

[Intermediate Transfer Member]

The intermediate transfer member is characterized in that the hardness (universal hardness) of the surface thereof is higher than that of the surface of the photoreceptor to be used in the invention.

The toner image can be suitably transferred from the photoreceptor, occurrence of toner filming can be prevented and the wearing of the intermediate transfer member can be inhibited by the use of the intermediate transfer member having the hardness higher than that of the photoreceptor.

The surface hardness of the intermediate transfer member can be controlled by the kind of the resin constituting the surface layer of the intermediate transfer member and the kind and amount of additives added to the surface layer.

The hardness (universal hardness) of the surface of the intermediate transfer member can be measured by a method the same as in the measurement for the photoreceptor.

The intermediate transfer member is preferably constituted by a belt substrate of a semiconductor having a volume resistivity of from $1\times10^4$ to $1\times10^{12}$ Ωcm.

As the material for forming the belt substrate, a resin such as a heat-hardenable polyimide resin and a modified polyimide, rubber such as an ethylene-propylene rubber (EPDM), acrylonitrile-butadiene rubber (NBR), a chloroprene rubber (CR) and a polyurethane rubber in which electroconductive filler such as carbon is dispersed, and an ionic electroconductive material are usable.

The toner and the developer are described below.

[Toner]

A toner containing a lubricant particle as an external additive and an abrasive is preferable though the toner is not specifically limited.

The cleaning ability of the surface of the photoreceptor and that of the intermediate transfer member can be improved and the remaining toner after cleaning and the occurrence of toner filming can be inhibited by the use of such the toner.

A usual lubricant particle suitably used such as zinc stearate and calcium stearate can be used. The adding ratio of the lubricant particle is preferably from 0.1 to 0.4% by weight.

A usual suitably used abrasive particle can be used. Example of the abrasive is an inorganic particle such as a particle of silica, titanium dioxide and barium sulfate. The adding ratio of the abrasive particle is preferably from 0.1 to 1.0% by weight.

[Developer]

A usual developer suitably used is applicable. A single-component developer and a double-component developer either can be used.

The single-component developer includes a non-magnetic single-component developer and a magnetic single-component developer containing a magnetic particle having a diameter of from 0.1 to 0.5 μm in the toner and both of them are usable.

In the case of the double-component toner, a usual suitably used magnetic material such as iron, ferrite, magnetite, and an alloy of such the metal and aluminum or lead is usable as the carrier. The ferrite particle is particularly preferable. The above magnetic particle preferably has a volume average particle diameter of from 15 to 100 μm, and more preferably from 25 to 80 μm.

The volume average particle diameter of the carrier can be measured by a laser diffraction particle size distribution measuring apparatus HEROS, manufactured by Sympatec Co., Ltd., having a wet type disperser.

The image forming apparatus is described below.

[Image Forming Apparatus]

The image forming apparatus according to the invention at least comprises a charging means for charging the surface of photoreceptor, a exposing means for forming an electrostatic latent image by imagewise exposing the charged photoreceptor, a developing means for developing the electrostatic latent image on the photoreceptor to form a toner image, a primary transferring means for transferring the toner image formed on the photoreceptor onto an intermediate transfer member and a secondary transferring means for transferring toner image transferred on the intermediate transfer member onto a recording medium.

The image forming apparatus according to the invention preferably has a cleaning means for cleaning the intermediate transfer member and a means for coating a lubricant on the surface of the photoreceptor additionally to the above means.

Figure 2:
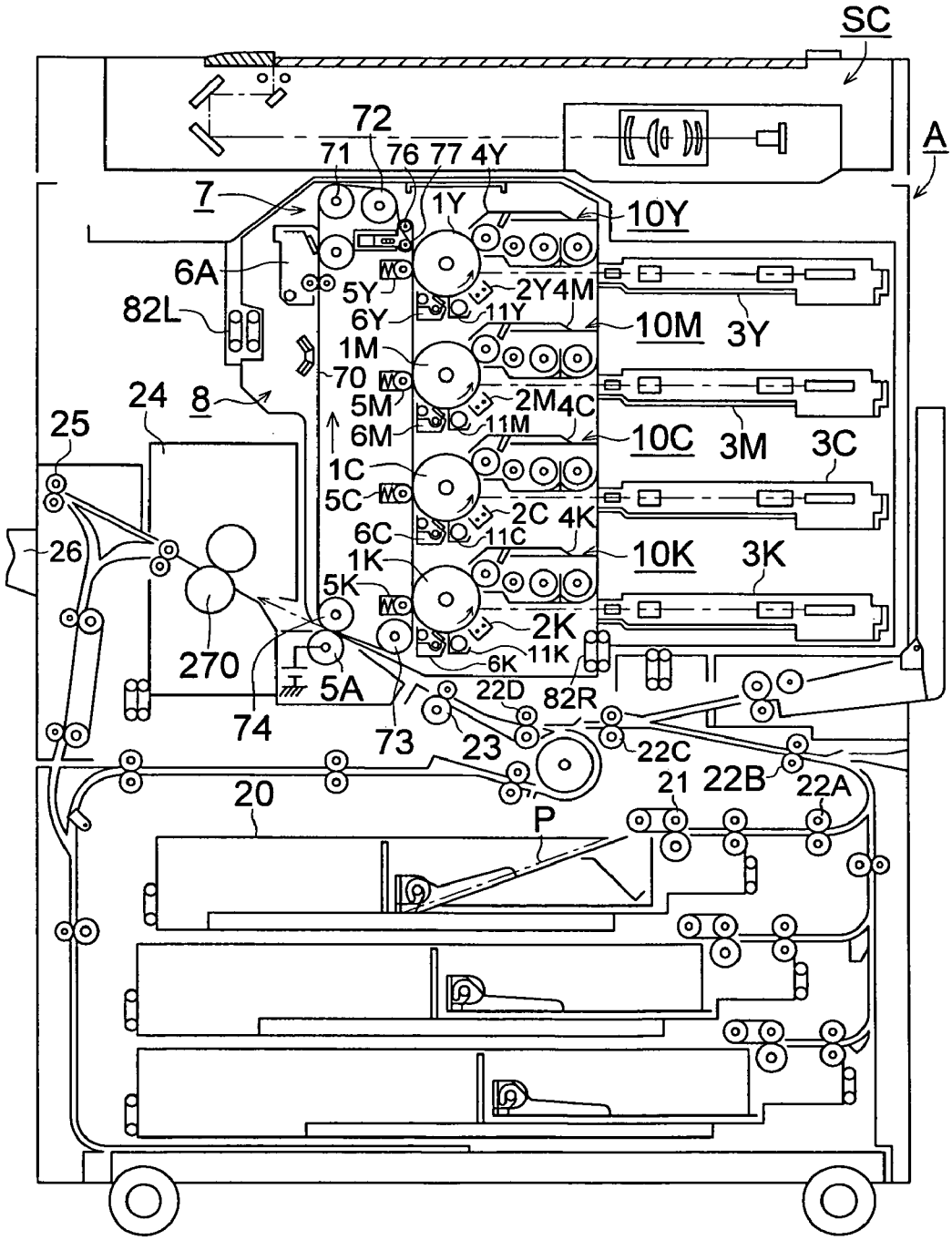
FIG. 2 shows a cross section of an example of image forming apparatus according to the invention.

FIG. 2 shows a cross section of an example of the image forming apparatus according to the invention.

This image forming apparatus is called as a tandem type color image forming apparatus, which has plural sets of image forming means 10Y, 10M, 10C and 10K, an endless belt-shaped intermediate transfer unit 7, an endless belt-shaped paper conveying means 21 for conveying a recording medium P and a belt type fixing device 24 as a fixing means. An image reading system SC is provided at the upper portion of the main body A of the image forming apparatus.

An image forming means 10Y for forming a yellow colored image, one of the different color images each formed on individual photoreceptors, has a drum-shaped photoreceptor 1Y as a primary image carrying member, and a charging means 2Y, an exposing means 3Y, a developing means 4Y, a primary transfer roller 5Y as a primary transferring means and a cleaning means 6Y each arranged around the photoreceptor 1Y.

An image forming means 10M for forming a magenta colored image, one of the different color images each formed on individual photoreceptors, has a drum-shaped photoreceptor 1M as a primary image carrying member, and a charging means 2M, an exposing means 3M, a developing means 4M, a primary transfer roller 5M as a primary transferring means and a cleaning means 6M each arranged around the photoreceptor 1M.

An image forming means 10C for forming a cyan colored image, one of the different color images each formed on individual photoreceptors, has a drum-shaped photoreceptor 1C as a primary image carrying member, and a charging means 2C, an exposing means 3C, a developing means 4C, a primary transfer roller 5C as a primary transferring means and a cleaning means 6C each arranged around the photoreceptor 1C.

An image forming means 10K for forming a black colored image, one of the different color images each formed on individual photoreceptors, has a drum-shaped photoreceptor 1K as a primary image carrying member, and a charging means 2K, an exposing means 3K, a developing means 4K, a primary transfer roller 5K as a primary transferring means and a cleaning means 6K each arranged around the photoreceptor 1K.

An endless belt-shaped intermediate transfer unit 7 has an endless belt-shaped intermediate transfer member 70 as a secondary image carrier circulatably supported by plural rollers.

Images different from each other in the color thereof individually formed by image forming means 10Y, 10M, 10C and 10K are successively transferred by the primary transfer rollers 5Y, 5M, 5C and 5K, respectively, onto the circulating endless belt-shaped transfer member 70 to form a synthesized color image. The recording medium P such as paper stocked in a paper supplying cassette 20 is conveyed by a paper conveying means 21 and supplied to a secondary transfer roller 5A as the secondary transferring means through plural intermediate rollers 22A, 22B, 22C and 22D and a resist roller 23, and the color image is collectively transferred onto the recording medium P. The recording medium on which the color image is transferred is subjected to fixing treatment by a belt type fixing device 24 and taken out on an output tray 26 by taking out rollers 25.

Besides, the endless belt-shaped intermediate transfer member 70 is cleaned by a cleaning means 6A for removing the remaining toner after transferring the toner image to the recording medium P by the secondary transfer roller 5A and separating the recording medium P utilizing the difference of the curvature.

The primary transfer roller 5K is constantly contacted with the photoreceptor 1K during the image forming process. The other primary transfer rollers 5Y, 5M and 5C are only contacted at the time for forming the color image to the corresponding photoreceptors 1Y, 1M and 1C, respectively.

The secondary transfer roller 5A is contacted to the endless belt-shaped intermediate transfer member 70 only at the time of secondary transfer by passing the recording medium P.

A case 8 is installed so that the case can be pulled out by supporting rails 82L and 82R.

The case 8 includes the image forming means 10Y, 10M, 10C and 10K and the endless belt-shaped intermediate transfer unit 7.

The image forming means 10Y, 10M, 10C and 10K are arranged in series in the vertical direction. The endless belt-shaped intermediate transfer unit 7 comprises the circulatable endless belt-shaped intermediate transfer member 70 circulating on rollers 71, 72, 73, 74 and 76, the primary transfer rollers 5Y, 5M, 5C and 5K, and the cleaning means 6A.

The image forming means 10Y, 10M, 10C and 10K and the endless belt-shaped intermediate transfer unit 7 can be pulled out as an integrated unit from the main body A.

As above-mentioned, toner images are each formed on the photoreceptors 1Y, 1M, 1C and 1K and piled on the endless belt-shaped intermediate transfer member 70, and then collectively transferred onto the recording medium P and fixed by heating and pressing by belt type fixing device 24. The photoreceptors 1Y, 1M, 1C and 1K are cleaned by removing the toner remaining thereon by the cleaning means 6A. After that, the image formation is repeated by the next cycle of the charging, exposing and developing.

In the image forming apparatus, the processing speed is 220 mm/second for A4 size recording medium, the primary transfer roller is a sponge roller having an electric resistance of $1\times10^7\Omega$ and a diameter of 20 mm, and the transfer is controlled by constant voltage control. In the color mode, a substrate 5T of the primary transfer rollers 5Y, 5M, 5C and 5K is slid by a pin D along a guide 5G for moving in the direction shown by the arrow A so that the rollers 5Y, 5M, 5C and 5K are each contacted by pressing to the photoreceptors 1Y, 1M, 1C and 1K, respectively, through the endless belt shaped intermediate transfer member 70 by the action of a spring S. In the monochromatic mode, however, the photoreceptor 1*k* is only contacted by pressing to the primary transfer roller 5*k* through the endless belt-shaped intermediate transfer member 70 and the contacting and pressing the primary transfer rollers 5Y, 5M and 5C to the photoreceptors 1Y, 1M and 1C and the endless belt-shaped intermediate transfer member 70 are released by moving the substrate 5T of the primary transfer rollers 5Y, 5M and 5C in the direction shown by the arrow B by the pin D.

In the above image forming apparatus an elastic blade is used as the cleaning material of the cleaning means 6A for cleaning the intermediate transfer member.

Means 11Y, 11M, 11C and 11K for coating a lubricant to each of the photoreceptors are provided each of the photoreceptors. Zinc stearate is used as the lubricant.

EXAMPLES

The invention is concretely described below referring examples but the invention is not limited to the examples.

<<Preparation of Photoreceptor>>

<Preparation of Photoreceptor 1>

(Electroconductive Substrate)

A cylindrical aluminum substrate was used which was shaved and washed so that the ten-point roughness Rz according to JIS-0601 of the surface was 0.81 μm.

(Formation of Intermediate Transfer Layer)

The following components were dispersed for 10 hours by a butch type sand mill and diluted by two times using the same solvent mixture and stood for one knight and then filtered by Rigimesh Filter, manufactured by Nihon Pall Co., Ltd., having a nominal filtering precision of 5 μm while applying a pressure of 50 kPa to prepare an intermediate layer coating liquid.

| Intermediate layer coating liquid | |
|---|---|
| Polyamide resin N-9 | 1.0 parts by weight |
| Solvent (ethanol/n-propyl alcohol/tetrahydrofuran = 5/2/3 in weight) | 10.0 parts by weight |

N-9

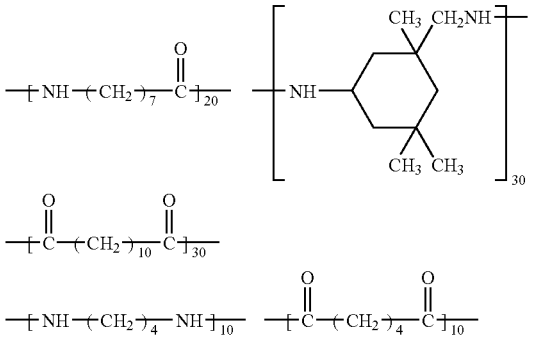

The above intermediate layer coating liquid was coated on the electroconductive substrate by an immersion coating method while controlling the dipping deepness so that the liquid was coated until the line far 15 mm from the upper end of the substrate and dried to form an intermediate layer.

The resultant intermediate layer was removed in a width of 15 mm from the lower end of the electroconductive substrate by a tape impregnating with a solvent, an ethanol/n-propyl alcohol/tetrahydrofuran mixture in a weight ratio of 5/2/3, to expose the lower portion of substrate. After that, the-resultant electroconductive substrate was treated by heating for 30 minutes at 120° C. Thus an intermediate layer having a thickness of 3.0 μm was formed. The thickness was a value measured by an eddy current layer thickness meter EDDY 560C, manufactured by Helmut Fischer GMBTE Co., Ltd.

(Formation of Charge Generation Layer)

A charge generation layer coating liquid was prepared by dispersing the following components by a sand mill dispersing machine.

| Charge generation layer coating liquid | |
|---|---|
| Y-type oxytitanylphthalocyanine pigment showing the maximum diffraction peak at a Bragg's angle (2Θ ± 0.2°) of 27.3° in the X-ray diffraction spectrum by characteristic Cu-Kα X-ray) | 20 parts by weight |
| Silicon-modified poly (vinyl butyral) | 10 parts by weight |
| 4-methoxy-4-methyl-2-pentanone | 700 parts by weight |
| t-butyl acetate | 300 parts by weight |

The above charge generation layer coating liquid was coated on the electroconductive substrate by an immersion coating method while controlling the dipping deepness so that the liquid was coated until the line far 13 mm from the upper end of the substrate and dried to form a charge generation layer.

The resultant charge generation layer was removed in a width of 13 mm from the lower end of the electroconductive substrate by a tape impregnating a solvent, a 4-methoxy-4-methyl-2-pentanone/t-butyl acetate mixture in a weight ratio of 7/3, to expose the lower portion of substrate. Thus a charge generation layer having a thickness of 0.3 μm was formed. The thickness was a value measured by an eddy current layer thickness meter EDDY 560C, manufactured by Helmut Fischer GMBTE Co., Ltd.

(Formation of Charge Transfer Layer)

A charge transfer layer coating liquid was prepared by dispersing the following components by a butch type sand mill dispersing machine for 10 hours and filtering through Rigimesh filter having a nominal filtering precision of 5 μm, manufactured by Nihon Pall Co., Ltd., with a pressure of 50 kPa.

| Charge transfer layer coating liquid | |
|---|---|
| 4-methoxy-4'-(4-methyl-α-phenylstyryl)triphenylamine | 70 parts by weight |
| Bisphenol Z type polycarbonate, IUPILON Z-300 (Mitsubishi Gas Kagaku Co., Ltd.) | 100 parts by weight |
| Inorganic particle: Titanium dioxide particle (Number average primary particle diameter: 33 nm) | 30 parts by weight |
| Organic particle: Polyester resin particle (Number average primary particle diameter: 70 nm) | 45 parts by weight |
| Antioxidant: IRGANOX 1010 (Nihon Ciba-Geigy Co., Ltd.) | 8 parts by weight |
| Solvent: Tetrahydrofuran/toluene mixture in a weight ratio of 8/2 | 750 parts by weight |

The above coating liquid was coated on the electroconductive substrate by an immersion coating method while controlling the dipping deepness so that the liquid was coated until the line far 10 mm from the upper end of the substrate and dried to form a charge transfer layer.

After that, the resultant charge transfer layer was removed in a width of 10 mm from the lower end of the electroconductive substrate by a tape impregnating a solvent, a tetrahydrofuran/toluene mixture in a weight ratio of 8/2, to expose the lower portion of substrate. Thus a charge transfer layer having a thickness of 25 μm was formed on the charge generation layer. The thickness was a value measured by an eddy current layer thickness meter EDDY 560C, manufactured by Helmut Fischer GMBTE Co., Ltd.

(Formation of Protective Layer)

The following components were dispersed and dissolved by a sand mill dispersing machine to prepare a protective layer coating liquid.

| Protective layer coating liquid | |
|---|---|
| 4-methoxy-4'-(4-methyl-α-phenylstyryl)triphenylamine | 50 parts by weight |
| Bisphenol Z type polycarbonate, IUPILON Z-800 (Mitsubishi Gas Kagaku Co., Ltd.) | 100 parts by weight |
| Inorganic particle: Titanium dioxide particle (Number average primary particle diameter: 33 nm) | 35 parts by weight |

-continued

| Protective layer coating liquid | |
|---|---|
| Organic particle: Polyester resin particle (Number average primary particle diameter: 70 nm) | 45 parts by weight |
| Antioxidant: IRGANOX 1010 (Nihon Ciba-Geigy Co., Ltd.) | 8 parts by weight |
| Solvent: Tetrahydrofuran/toluene mixture in a weight ratio of 8/2 | 750 parts by weight |

The above protective layer coating liquid was coated on the charge transfer layer by a circular coating amount regulation coating apparatus and dried to form a protective layer having a thickness of 6 μm. Thus Photoreceptor 1 was prepared. The thickness was a value measured by an eddy current layer thickness meter EDDY 560C, manufactured by Helmut Fischer GMBTE Co., Ltd.

(Preparation of Photoreceptors 2 to 5 and 7 to 9)

Photoreceptors 2 to 5 and 7 to 9 were prepared in the same manner as in Photoreceptor 1 except that the inorganic particle and the organic particle were changed as shown in Table 1. These photoreceptors were corresponding to FIG. 1*b*.

(Preparation of Photoreceptor 6)

Photoreceptor 6 was prepared in the same manner as in Photoreceptor 1 except that the protective layer was not applied so that the charge transfer layer became the surface layer. This photoreceptor was corresponding to FIG. 1*a*.

The layer constitution, the kind and the number average primary particle diameter of the inorganic and organic particles used for preparing the charge transfer layer and the protective layer and the ratio of the inorganic particle of Photoreceptor 1 to 9 are listed in Table 1.

TABLE 1

| Photo-receptor | Layer | Charge transfer layer | | | | | Protective layer | | | | |
|---|---|---|---|---|---|---|---|---|---|---|---|
| | | Inorganic particle | | Organic particle | | | Inorganic particle | | Organic particle | | |
| No. | constitution | Kind | *1 | Kind | *1 | *2 | Kind | *1 | Kind | *1 | *2 |
| 1 | FIG. 1b | Titanium dioxide | 33 | Polyester resin | 70 | 40 | Titanium dioxide | 33 | Polyester resin | 70 | 40 |
| 2 | FIG. 1b | — | — | — | — | — | Alumina | 1 | Ethylene tetrafluoride resin | 98 | 40 |
| 3 | FIG. 1b | — | — | — | — | — | Titanium dioxide | 50 | Ethylene tetrafluoride resin | 200 | 60 |
| 4 | FIG. 1b | — | — | — | — | — | Titanium dioxide | 200 | — | — | 100 |
| 5 | FIG. 1b | — | — | — | — | — | — | — | Polyester resin | 120 | 0 |
| 6 | FIG. 1a | Titanium dioxide | 33 | Polyester resin | 70 | 40 | — | — | — | — | — |
| 7 | FIG. 1b | — | — | — | — | — | silica particle | 0.8 | — | — | 100 |
| 8 | FIG. 1b | — | — | — | — | — | Titanium dioxide | 300 | Ethylene tetrafluoride resin | 210 | 80 |
| 9 | FIG. 1b | — | — | — | — | — | — | — | — | — | — |

*1: Number average primary particle diameter (nm),
*2: Ratio of inorganic particle (Ratio by weight)

<<Intermediate Transfer Member>>

As an intermediate transfer member of inventive example, an endless belt-shaped heat hardenable polyimide intermediate transfer member having a thickness of 100 μm and a surface hardness (universal hardness) of 280 N/mm$^2$, referred to as Intermediate transfer member 1, and one the same as the above except that the hardness was 390 N/mm$^2$, referred to as Intermediate transfer member 2, were prepared. Further, as an intermediate transfer member of comparative example, an intermediate transfer member having a surface hardness (universal hardness) of 180 N/mm$^2$, referred to as Intermediate transfer member 3, was prepared.

The hardness of the intermediate transfer member of inventive example was controlled by the amount of the silica particle to be added to the heat-hardenable polyimide and the condition for the heat hardening treatment.

<<Production of Intermediate Transfer Member>>

Production of coating layer forming liquid (Production of Coating Layer Forming Liquid 1)

Mole equivalents of 3,3',4,4'-biphenyltetra carboxylic acid dianhydride (BPDA) and p-phenylenediamine (PDA) were subjected to polycondensation reaction at 20° C. in N methyl pyrrolidinone (NMP) solvent, whereby 2 kg of "aromatic polyamide acid solution" (solution viscosity 4.1 Pass) containing solid content of 16% by mass was synthesized.

In 2 kg of "aromatic polyamide acid solution 1", 180 g of silica particles (number average primary particle diameter: 28 nm, specific surface area: 50 m$^2$/g, average circularity: 0.9), together with 72 g of carbon black (pH: 7, primary particle diameter: 21 nm) as a conductive substance, and 462.4 g of N methyl pyrrolidinone as a dilution solvent were added, and agitated and mixed by using Three-one Motor (made by Shinto science company), and then this mixture was shifted to put in a sand grinder and further mixed and dispersed sufficiently, whereby "coating layer forming liquid 1" was obtained.

<Production of Intermediate Transfer Belt 1>

Figure 3:
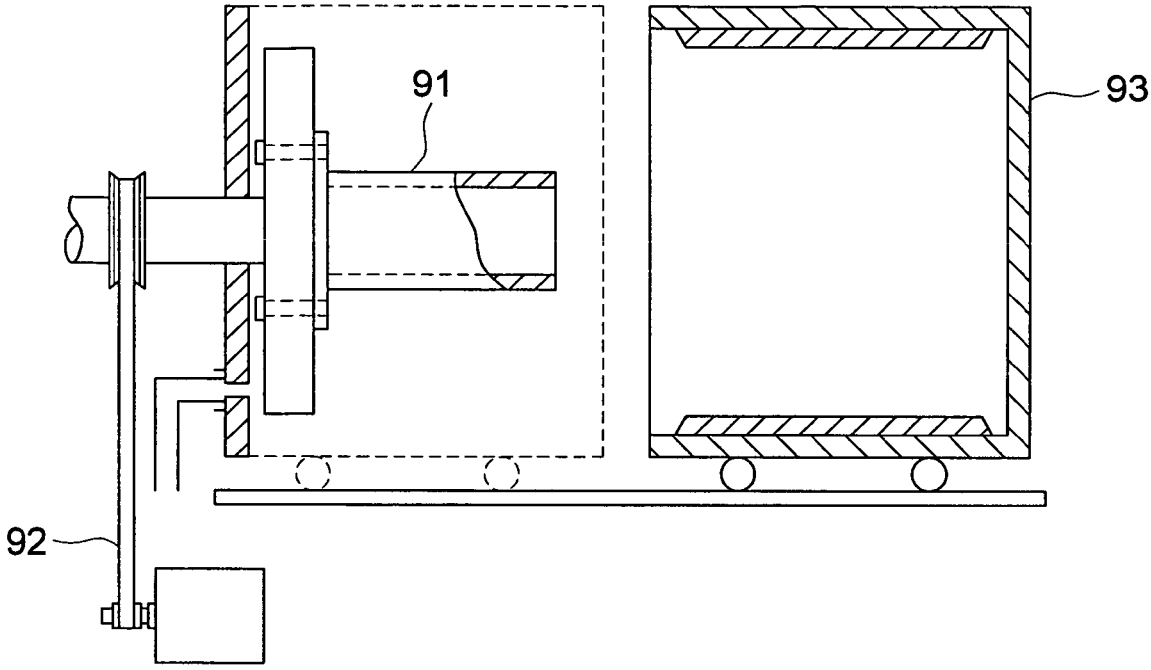
FIG. 3 is a cross section showing a main section of a centrifugal shaping apparatus.

A pipe-shaped coating head (not depicted) was inserted in an inside of a cylinder (metal die) 91 in a centrifugal shaping apparatus shown in FIG. 3 and "coating layer forming liquid 1" was coated from a slit of the coating head on an internal surface of the cylinder while the cylinder was rotated at 1000 rpm for 10 minutes by a rotating device 92, whereby a uniform coating layer was formed on the internal surface of the cylinder. Subsequently, the cylinder was heated to 150 degrees C. by a heater 93 and drying solvent and hardening the coating layer were conducted for 30 minutes while the cylinder was rotated.

Thereafter, the temperature was cooled down to a room temperature, then, a belt formed by the coating layer was pulled out from the inside of the cylinder. On the condition that a shaping frame was installed in the inside of the belt, the temperature was firstly increased to 200 degrees C. at a rate of 10 degrees C./min, subsequently increased to 380 degrees C. at a rate of 5 degrees C./min, and then the belt was heated at 380 degrees C. for 30 minutes, whereby a surface layer on which imide conversion was advanced was formed.

Thereafter, the temperature was cooled down to a room temperature, the belt was removed from the shaping frame and the universal hardness of the removed belt was 280 $N/mm^2$. The belt was referred as "Intermediated transfer belt 1" having a thickness of 85 μm.

<Production of Intermediate Transfer Belt 2>

Intermediate transfer belt 2 was produced with the same manner for the intermediate transfer belt 1, except that the amount of silica particles was changed to 250 g and the rotation speed of the cylinder was changed to 1500 rpm. The universal hardness of Intermediate transfer belt 2 was 390 $N/mm^2$.

<Production of Intermediate Transfer Belt 3>

In 800 g of N-methyl-2-pyrrolidone (hereinafter, referred ad NMP), 45.3 g of dried carbon black (23 weight parts for PI solid content) was added, stirred at room temperature for 6 hours using a ball mill. In thus obtained NMP dispersion liquid, 140 g of BPDA as an acid composition and 40 g of paraphenylenediamine and 30.0 g of 4,4-diamino diphenyl ether as amine compositions were dissolved, and stirred at room temperature for 3 hours under a nitrogen atmosphere whereby polyamide acid of 900 Pa·S (B type viscometer at 25 degrees C.) was obtained. Subsequently, in the polyamide acid, a solution consisting of 102 g (2 mol equivalent) of acetic anhydride being a dehydrating agent, 12.9 g (0.2 mol equivalent) of isoquinoline used as a catalyst and 150 g of NMP were added, stirred and mixed, thereafter, the resultant liquid was coated on an inner surface of a metal die. Then, by rotating at 2000 rpm for 15 minutes so that a uniform coating layer surface was obtained. Next, hot air of 100 degrees C. was applied on an outside of the metal die for 10 minutes, thereafter it was heated for 10 minutes with 220 degrees C. and for 30 minutes with 300 degrees C. as the highest heating temperature, whereby the solvent, the dehydrating agent and the catalyst were removed and imide-conversion was completed. Then, the metal die was cooled down to a room temperature and a belt was taken out from the metal die, whereby a semi-conductive polyimide belt was obtained. This belt was referred as Intermediate transfer belt 3 and the universal hardness of this belt was 180 $N/mm^2$.

<<Developer>>

A toner composed of colored particle having a number based median particle diameter ($D_{50}$) of 6 μm and external additives of silica particle having a number average primary particle diameter of 50 nm, fine titanium dioxide particle having a number average primary particle diameter of 20 nm and calcium stearate was prepared.

A developer was prepared by mixing the above toner and ferrite carrier having a number average primary particle diameter of 60 μm so that the toner concentration was made to 4% by weight.

A developing device using the above double-component developer was used as the developing means.

<<Image Forming Apparatus for Evaluation>>

Image forming apparatuses 1 to 3 were prepared. The concrete constitutions of the apparatuses were as follows.

<Image Forming Apparatus 1>

(1) The above prepared Photoreceptors 1 to 9 were successively installed.

(2) A scorotron charging device was used for the charging means.

(3) A semiconductor laser irradiation device having a standard output power of 300 μW was used for the exposing means.

(4) The above prepared developer was used for the developing means.

(5) The above prepared intermediate transfer member was used for the primary transfer means and a transfer roller was used for the transferring.

(6) The above prepared intermediate transfer member was used for the secondary transfer means and a transfer roller was used for the transferring.

(7) In the cleaning means for the intermediate transfer member, an elastic blade was used as the cleaning member.

(8) In the coating means for coating a lubricant to the intermediate transfer member and zinc stearate powder was used as the lubricant.

<Image Forming Apparatus 2>

An apparatus the same as Image forming apparatus 1 except that a far brush was used in place of the elastic blade <Image Forming Apparatus 3>

An apparatus the same as Image forming apparatus 1 except that the coating means for coating the lubricant to the photoreceptor was eliminated <<Image Evaluation>>

An original image, in which an image including 3-point and 5-pint characters having a pixel ratio of 7%, a portrait (A dot image containing half tone), a slid white image and a black solid image were arrange in each of quartered areas, was printed on A4 size neutral paper having a weight of 64 $g/m^2$ by the above Image forming apparatus 1 to 3. Thus obtained toner images were subjected to the following evaluation.

(White Lacking in Solid Image)

The original image was printed under a high temperature and high humidity condition at 30° C. and 85% RH.

The evaluation of the white lacking in the solid image was carried out by counting the number or white lacking having a major diameter of not less than 0.4 mm par an A4 size solid image. The major diameter of the white lacking was measured by a microscope with a video printer.

Norms of Evaluation

A: Frequency of white lacking of not less than 0.4 mm: The white lacking of not more than 3/A4 were win all prints.

B: Frequency of white lacking of not less than 0.4 mm: One or more prints having 4 to 19/A4 of the white lacking were formed.

C: Frequency of white lacking of not less than 0.4 mm: One or more prints having not less than 20/A4 of the white lacking were formed.

(Lacking Inside Character Image)

The original image was printed under a low temperature and humidity condition of 10° C. and 15% RH.

The printed images of the 3-point and 5-point characters were observed by enlarging by a loupe and the situation of the occurrence of lacking in the interior of the character images was visually evaluated.

Norms of Evaluation

A: No lacking was observed inside the 3-point and 5-point character images until 50,000$^{th}$ prints.

B: No lacking was observed inside the 3-point character image until 50,000$^{th}$ prints.

C: Remarkable lacking inside the 3-point and 5-point character images was observed on the 50,000$^{th}$ print.

(Fogging)

The absolute density of the neutral paper before printing was measured at 20 points and the average of the densities was defined as the density of the white paper. Besides, the absolute density of the paper after printing white solid image was measured at 20 points in the same procedure and the average of the measured values was calculated. The difference of the average value and the white paper density was evaluated as the fog density. The measurement was carried out by a Macbeth densitometer RD-918.

Norms of Evaluation

A: The fog was not more than 0.005 on both of the initial and 100,000$^{th}$ print.

B: The fog was not more than 0.005 on the initial print and not more than 0.1 on the 1,000,000$^{th}$ print; such the level of fogging does not cause any problem in practical use.

C: The fog was more than 0.01 on both of the initial and 100,000$^{th}$ prints; such the fogging level caused problem in practical use.

(Black Spots)

The evaluation was carried out about 100 sheets of non-image prints printed after 100,000 sheets of image printing. The number of visible black spots occurring in a cycle meeting with the rotating cycle of the photoreceptor and having a diameter of not less than 0.4 mm per A4 size hard copy was counted.

Norms of Evaluation

A: The occurring frequency of the black spot was not more than 3/A4 sheet in the all hard copies; suitable.

B: One or more copies having the black spots of not less than 4/A4 sheet and not more than 10/A4 sheet occurred in the all hard copies; no problem in practical use.

C: One or more copies having the black spots of not less than 11/A4 sheet occurred in the all hard copies; a problem was caused in practical use.

(Image Density)

The image density was evaluated according to the density of the solid black printed image. The measurement of the density was carried out by RD-918, manufactured by Macbeth Co., Ltd., and expressed by a relative density when the density of the paper was set at 0.

Norms of Evaluation

A: The image density was not less than 1.2 on both of the initial print and the 1,000,000$^{th}$ print; suitable.

B: The image density of the initial print was not less than 1.2 and that of the 1,000,000$^{th}$ prints was not less than 1.0; no problem was caused in practical use on such the level.

C: The image density was less than 1.0 on both of the initial print and the 1,000,000$^{th}$ print; a problem was caused in practical use.

(Sharpness)

The sharpness was evaluated by visually observing through a loupe with a magnitude of 10 the character images of the copy print of the original image printed after 1,000,000 sheets of printing.

Norms of Evaluation

A: Images of both of the 3-point and 5-point characters were clear and easily readable; suitable.

B: A part of the 3-point characters was unreadable and the 5-point characters were clear and easily readable; no problem was caused in practical use.

C: The 3-point characters were almost unreadable and the 5-point characters partially or almost unreadable; a problem was caused in practical use.

Results of the evaluation are listed in Table 2.

TABLE 2

| | | Photoreceptor | | Intermediate transfer member | | | Lacking in | | | | |
|---|---|---|---|---|---|---|---|---|---|---|---|
| | *1 | No. | Surface hardness (universal hardness) (N/mm$^2$) | No. | Surface hardness (universal hardness) (N/mm$^2$) | White lacking in solid image | interior of character image | Fog | Black spot | Image density | Sharp-ness |
| Example 1 | 1 | 1 | 240 | 1 | 280 | B | B | B | B | A | A |
| Example 2 | 1 | 2 | 210 | 1 | 280 | A | A | A | A | A | A |
| Example 3 | 1 | 3 | 220 | 1 | 230 | B | A | A | A | A | A |
| Example 4 | 1 | 4 | 350 | 2 | 390 | B | A | A | A | A | A |
| Example 5 | 1 | 5 | 200 | 1 | 280 | A | A | A | A | A | B |
| Example 6 | 1 | 6 | 220 | 1 | 280 | A | A | A | A | A | A |
| Example 7 | 2 | 2 | 260 | 1 | 280 | B | B | A | A | A | B |
| Example 8 | 3 | 2 | 220 | 1 | 280 | B | B | A | A | A | B |
| Comparative example 1 | 1 | 7 | 180 | 1 | 280 | C | B | C | C | C | C |
| Comparative example 2 | 1 | 8 | 370 | 2 | 390 | C | B | C | B | B | C |
| Comparative example 3 | 1 | 9 | 100 | 1 | 280 | B | C | C | C | C | B |
| Comparative example 4 | 1 | 1 | 240 | 3 | 180 | B | C | B | B | C | B |

*1: Constitution of image forming apparatus

It is understood from Table 2 that the high quality toner images without any problem in the all evaluation items are obtained in Examples 1 through 8 of the invention. Besides, a problem is caused in any evaluation item of Comparative examples 1 through 4.

What is claimed is:

1. An electrophotographic image forming apparatus, comprising:

an electrophotographic photoreceptor;

an image forming section for forming a toner image on a surface of the electrophotographic photoreceptor;

an intermediate transfer member;

a first transferring section for transferring the toner image formed on the surface of the electrophotographic photoreceptor to a surface of the intermediate transfer member;

a second transferring section for transferring the toner image transferred on the surface the intermediate transfer member to a recording medium; and a lubricant supplying section to supply lubricant onto the surface of the electrophotographic photoreceptor;

wherein the electrophotographic photoreceptor comprises a surface layer forming the surface thereof and containing particles having a number average primary particle diameter of 1 to 300 nm, the particles include at least inorganic particles and organic particles and the surface of the electrophotographic photoreceptor has a hardness of 200 to 350 $N/mm^2$ in universal hardness which is lower than the hardness in universal hardness of the surface of the intermediate transfer member.

2. The electrophotographic image forming apparatus of claim 1, wherein the surface of the electrophotographic photoreceptor has a hardness of 250 to 350 $N/mm^2$ in universal hardness.

3. The electrophotographic image forming apparatus of claim 1, wherein the hardness of the surface of the electrophotographic photoreceptor is 20 $N/mm^2$ lower than the hardness of the surface of the intermediate transfer member.

4. The electrophotographic image forming apparatus of claim 1, wherein the hardness of the surface of the electrophotographic photoreceptor is 25 to 80 $N/mm^2$ lower than the hardness of the surface of the intermediate transfer member.

5. The electrophotographic image forming apparatus of claim 1, wherein the surface of the intermediate transfer member has a hardness of 220 to 430 $N/mm^2$ in universal hardness.

6. The electrophotographic image forming apparatus of claim 1, wherein the surface of the intermediate transfer member has a hardness of 280 to 370 $N/mm^2$ in universal hardness.

7. The electrophotographic image forming apparatus of claim 1, wherein the inorganic particles are selected from silica particles, alumina particles, titanium dioxide particles and strontium titanate particles.

8. The electrophotographic image forming apparatus of claim 1, wherein the inorganic particles have a number average primary particle diameter of 10 to 150 nm.

9. The electrophotographic image forming apparatus of claim 1, wherein the organic particles are selected from fluorine atom-containing particles, silicone atom-containing particles, polyolefin particles, and polyester particles.

10. The electrophotographic image forming apparatus of claim 1, wherein the organic particles have a number average primary particle diameter of 20 to 250 nm.

11. The electrophotographic image forming apparatus of claim 1, wherein the content of the inorganic particle in the amount of the inorganic particle and the organic particle is 20 to 80% by mass.

12. The electrophotographic image forming apparatus of claim 11, wherein the content of the inorganic particle in the amount of the inorganic particle and the organic particle is 30 to 70% by mass.

13. The electrophotographic image forming apparatus of claim 1, wherein the surface of the electrophotographic photoreceptor is formed by a charge transfer layer.

14. The electrophotographic image forming apparatus of claim 1, wherein the surface of the electrophotographic photoreceptor is formed by a protective layer.

15. The electrophotographic image forming apparatus of claim 1, wherein the intermediate transfer member comprises a semi-conductive belt substrate having a volume resistivity of $1\times10^4$ to $1\times10^{12}$ Ωcm.

16. The electrophotographic image forming apparatus of claim 15, wherein the material of the belt substrate of the intermediate transfer member is selected from a resin material of a heat-hardenable polyimide resin and a modified polyimide resin, and a rubber material of an ethylene-propylene rubber (EPDM), an acrylonitrile-butadiene rubber (NBR), a chloroprene rubber (CR) and a polyurethane rubber in which electroconductive filler is dispersed, or an ionic electroconductive material is contained.

17. The electrophotographic image forming apparatus of claim 16, wherein the material of the belt substrate of the intermediate transfer member is a heat-hardenable polyimide in which silica particles are added.

18. The electrophotographic image forming apparatus of claim 16, wherein the first transferring section comprises a sponge roller whose surface includes an insulating layer.

* * * * *